US007370919B2

(12) United States Patent
Rapier, III

(10) Patent No.: US 7,370,919 B2
(45) Date of Patent: May 13, 2008

(54) WASTE CONTAINER WITH HIDDEN SLIDES

(75) Inventor: James L. Rapier, III, Kernersville, NC (US)

(73) Assignee: Peter Meier, Inc., Kernersville, NC (US)

( * ) Notice: Subject to any disclaimer, the term of this patent is extended or adjusted under 35 U.S.C. 154(b) by 294 days.

(21) Appl. No.: 10/613,306

(22) Filed: Jul. 7, 2003

(65) Prior Publication Data

US 2005/0006994 A1 Jan. 13, 2005

(51) Int. Cl.
*A47B 88/00* (2006.01)

(52) U.S. Cl. ..... 312/310; 312/308; 312/270.1

(58) Field of Classification Search ..... 312/330.1, 312/301, 274, 270.1, 270.3, 273, 211, 212, 312/298; 220/909
See application file for complete search history.

(56) References Cited

U.S. PATENT DOCUMENTS 3,528,718 A * 9/1970 Johnson et al. ..... 312/308
5,251,975 A * 10/1993 Braun et al. ..... 312/334.16
5,938,305 A * 8/1999 Rubsam-Tomlinson .. 312/270.1

FOREIGN PATENT DOCUMENTS

DE 3516547 * 11/1986

OTHER PUBLICATIONS

Baer Product Catalog, "Cabinet and Counter Accessories", pp. F-626 through F-629, Dec. 1998.*
C.H. Briggs Hardware Co., Product Brochure, pp. D-14 through D-18, Dec. 1998.*
Hafele, Product Brochure, "Trash Cans", pp. 5.35 through 5.37, Dec. 1998.*

* cited by examiner

*Primary Examiner*—James O. Hansen
(74) *Attorney, Agent, or Firm*—MacCord Mason PLLC

(57) ABSTRACT

A kitchen trash container system that has a tray slidably movable into and out of a kitchen cabinet when waste is placed in a container carried by the tray. A slide mechanism is positioned on the inside walls of the cabinet engaging another cooperating slide mechanism fastened to the top of the container or inside the tray walls or floor. The container top extends over both engaging slides on each side of the container to shield the mechanisms from dust and debris and hide them from view.

14 Claims, 10 Drawing Sheets

WASTE CONTAINER WITH HIDDEN SLIDES

BACKGROUND OF THE INVENTION

1. Field of the Invention

The present invention provides a waste collection system in which a waste container is stored in a tray within a kitchen cabinet that is movable out of the cabinet to receive waste or allow the container to be emptied and movable into the cabinet for storage and concealment wherein the slide mechanism for the tray is concealed and positioned to prevent the collection of dust and particles therein.

2. Description of the Prior Art

A typical kitchen waste collection system is often positioned within a kitchen cabinet on a tray with a slide mechanism so that the user can withdraw the waste receptacle and place waste and refuse therein. The slide mechanism is usually installed in exposed locations between the cabinet inside walls and the outside walls of the tray where it readily gathers unwanted and damaging dust and particles. Thus there is a need to shelter the slide mechanism from such exposure and hide the mechanism from view. It is to this need that the present invention is directed.

SUMMARY AND OBJECTIVES OF THE INVENTION

The present invention is a kitchen trash container system which includes a tray slidably movable out of and into a kitchen cabinet when waste is deposited in a waste container carried by the tray. A slide mechanism is positioned on each inside wall or top of the cabinet and in engagement with another cooperating slide mechanism affixed either to the top or lower end of the waste container or inside the tray walls or floor. The container top extends over both engaging slides on each side of the container to shield the mechanisms from dust and debris and hide them from view. Alternatively, a slide cover may be used on each side of the container particularly when a wire device is used. The container top may have a handle or hand grip formed therein to facilitate removing or introducing the container from or into the cabinet. The tray may be formed as an open container or as a wire rack and may be designed to hold one or more waste containers. A false door may be affixed directly to the front end of the tray or a cabinet door may be used to close the cabinet when the tray and carried waste container is moved into the cabinet. The tray drawer slide may utilize a self closing feature and a shock absorber to ensure quiet movement and efficient operation.

From the foregoing summary, it can be seen that a primary objective of the present invention is to provide waste collection system that has all of the advantages of prior art devices and more and none of the disadvantages.

Another objective of the present invention is to provide a waste collection system designed to protect the cooperating tray-supporting slides from the accumulation of dust, dirt and other foreign materials.

Yet another objective of the present invention is to provide several alternative embodiments of a tray or door supporting slide mechanism with slide hiding and protecting features.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

The drawings are included to provide a further understanding of the invention and are incorporated in and constitute a part of this specification. They illustrate embodiments of the invention and, together with their description, serve to explain the principles of the invention.

DETAILED DESCRIPTION

Figure 5:
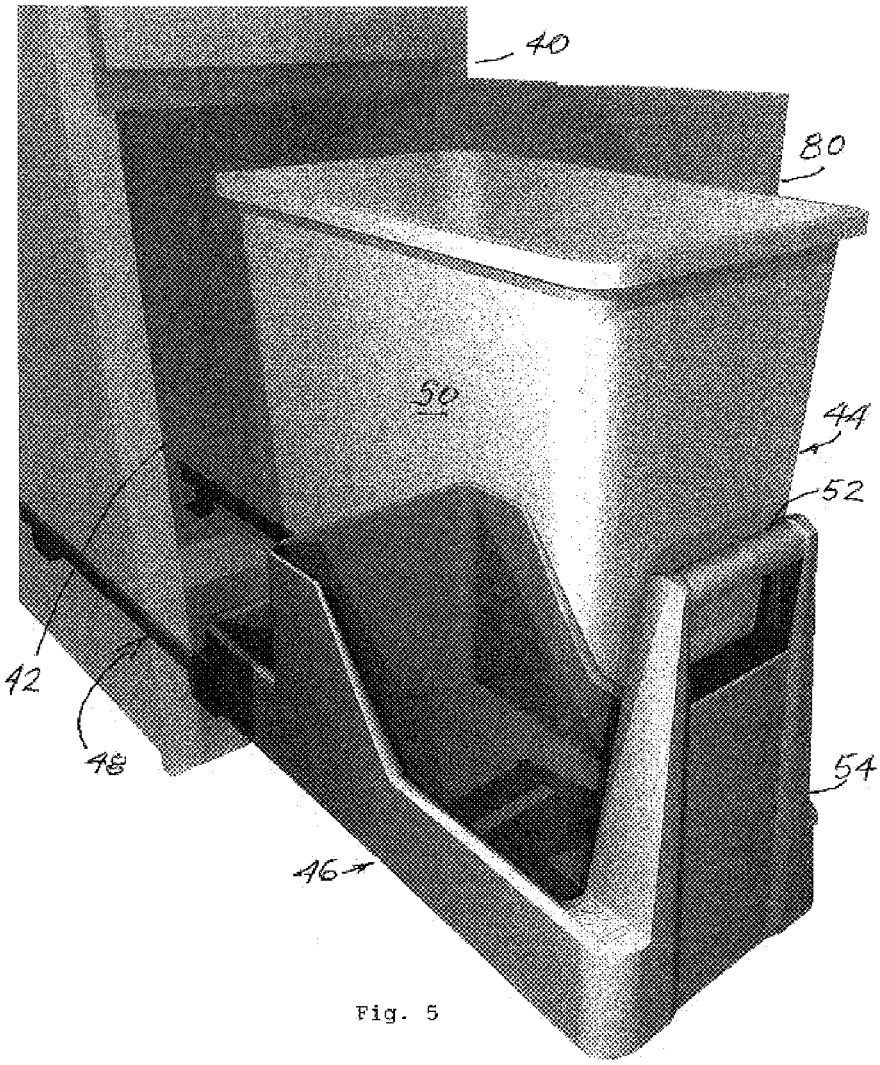
FIG. 5 is a perspective view of one embodiment of a tray, container and slide mechanism combination in an open position.
Figures 6, 6A:
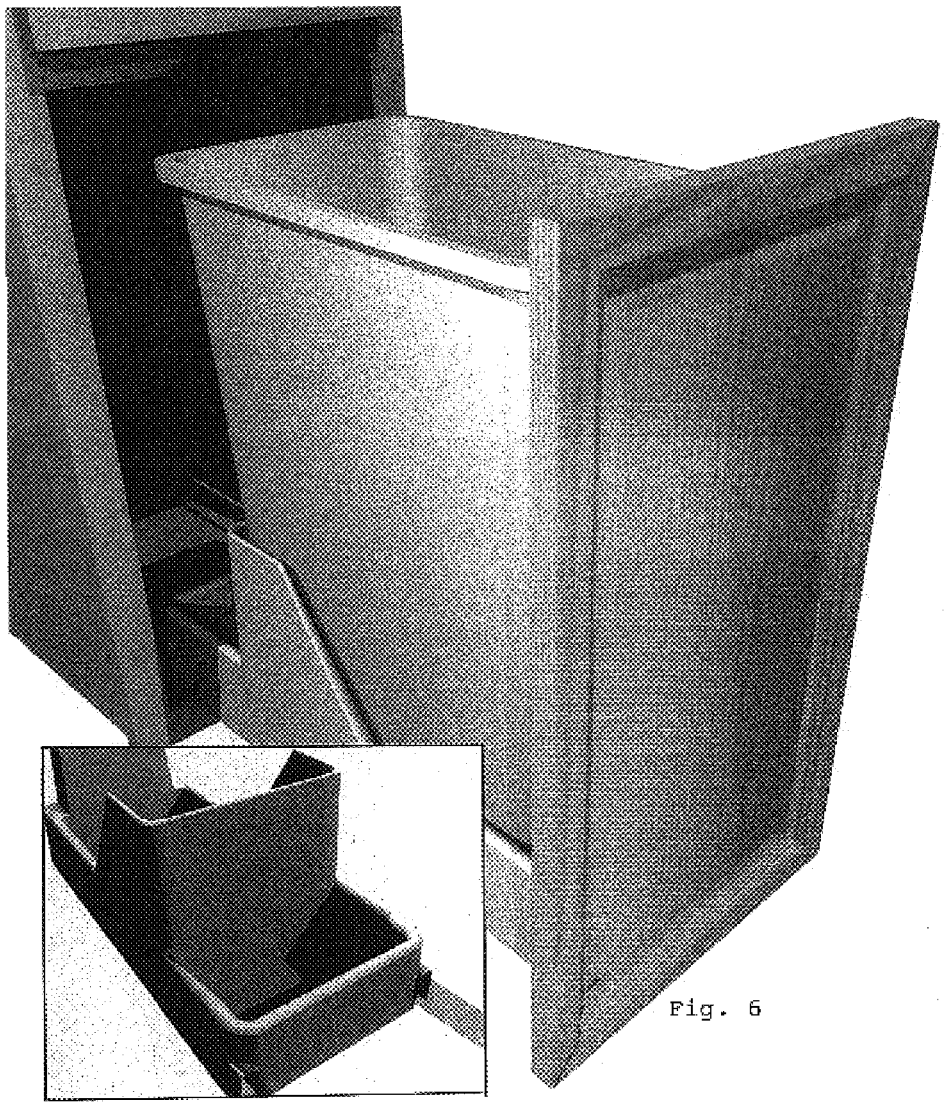
FIG. 6 is a perspective view of another embodiment of a tray, container and slide mechanism in an open position.
FIG. 6*a* is a perspective of the configuration of FIG. 6 showing the back and hidden slides associated therewith.
Figure 7:
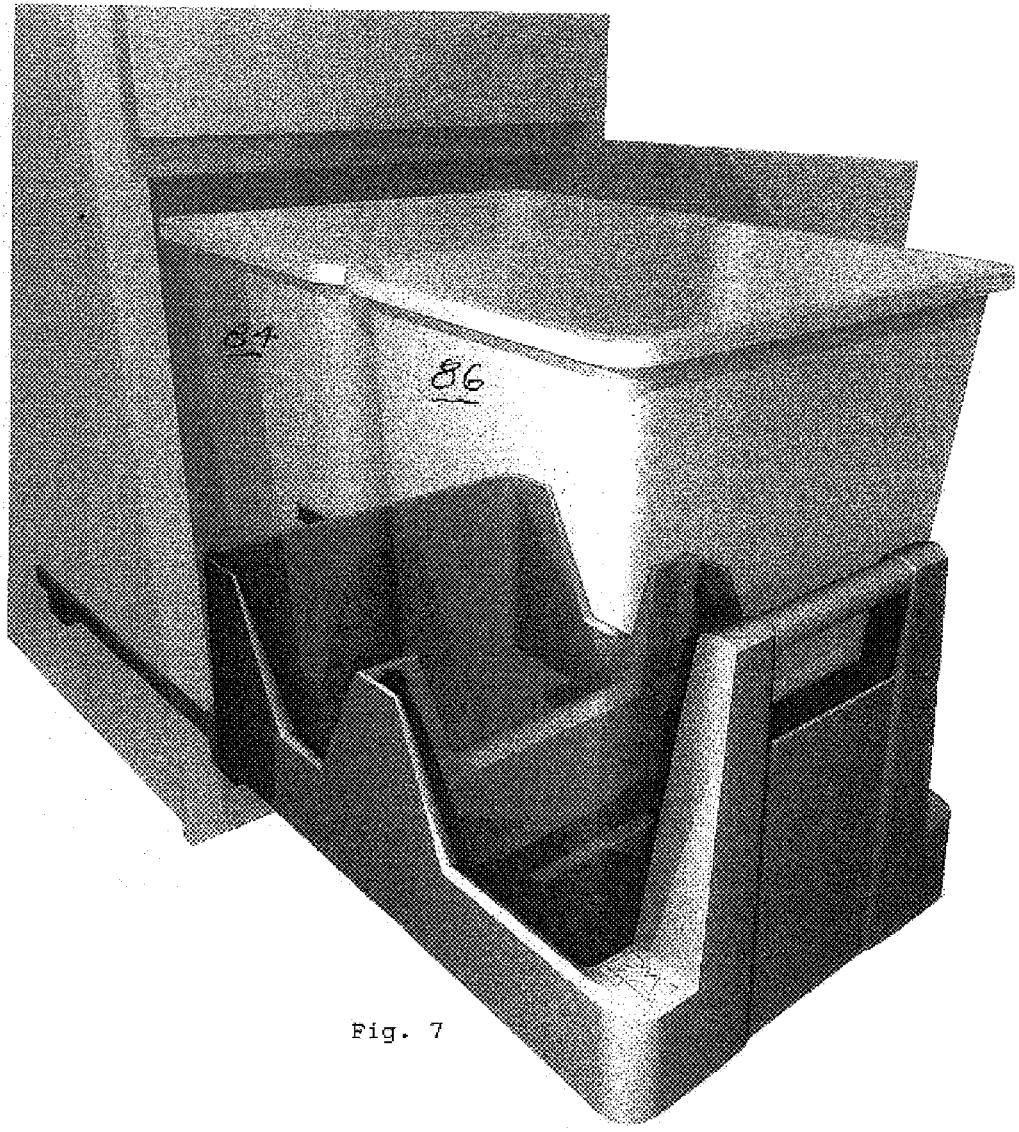
FIG. 7 is a perspective view of another embodiment of a tray, container and slide mechanism in an open position.
Figure 8:
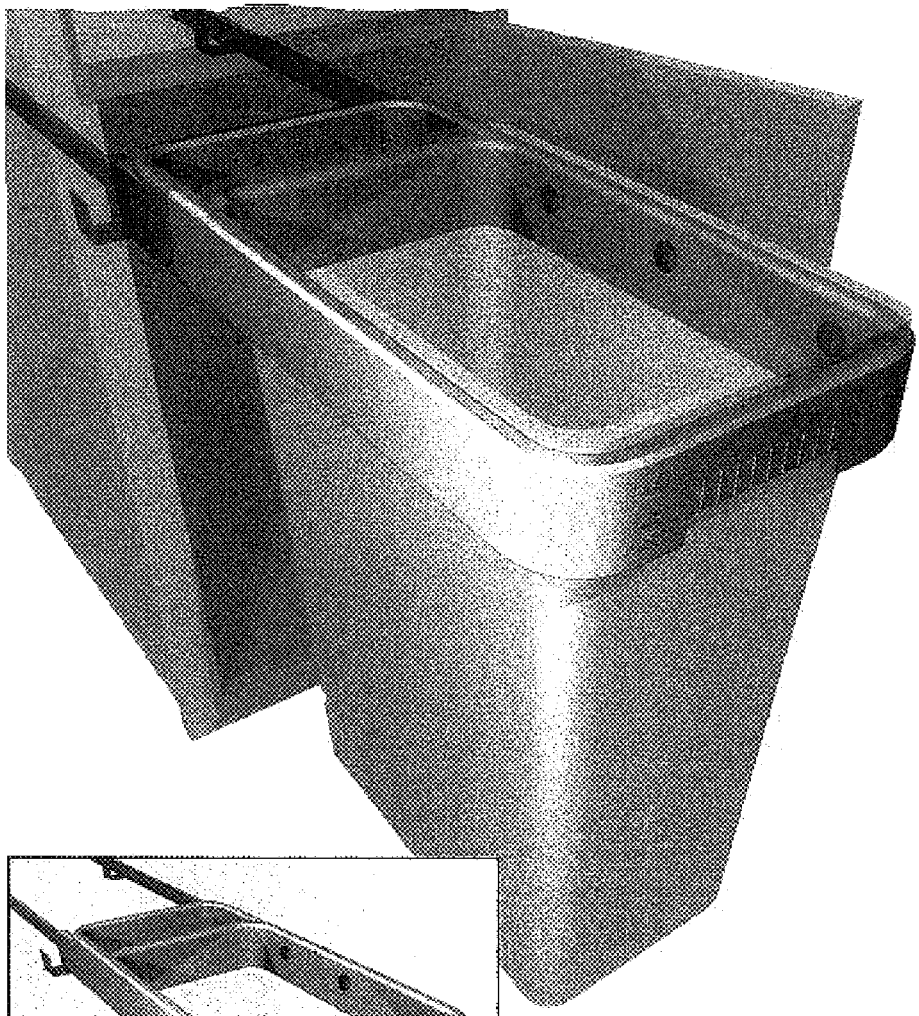
FIG. 8 is a perspective view of another embodiment of a tray, container and slide mechanism in an open position.
Figure 8A:
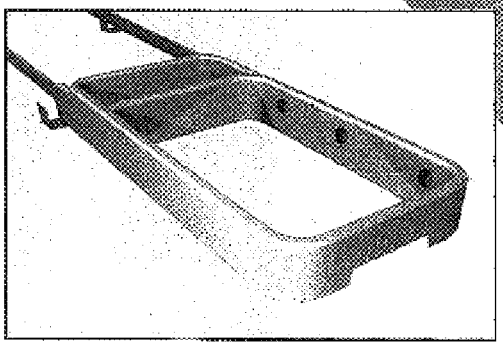
FIG. 8*a* is a perspective view of the slide mechanism shown in FIG. 8.

Referring now to the drawings and particularly to FIG. 5, a kitchen cabinet 40 has an open interior 42 in which can be housed a waste collection system shown generally as 44. System 44 includes a tray 46 movable into and out of interior 42 by a slide arrangement shown generally as 48. A waste container so rests on tray 46 and is sized to fit snugly within interior 42. Tray 46 in this embodiment has a handle 52 at its front end 54 which is convenient for a user to pull tray 46 and container 50 out of cabinet 40 when a waste deposit is to made into container 50 or when container 50 needs to be emptied and replaced.

Figure 10:
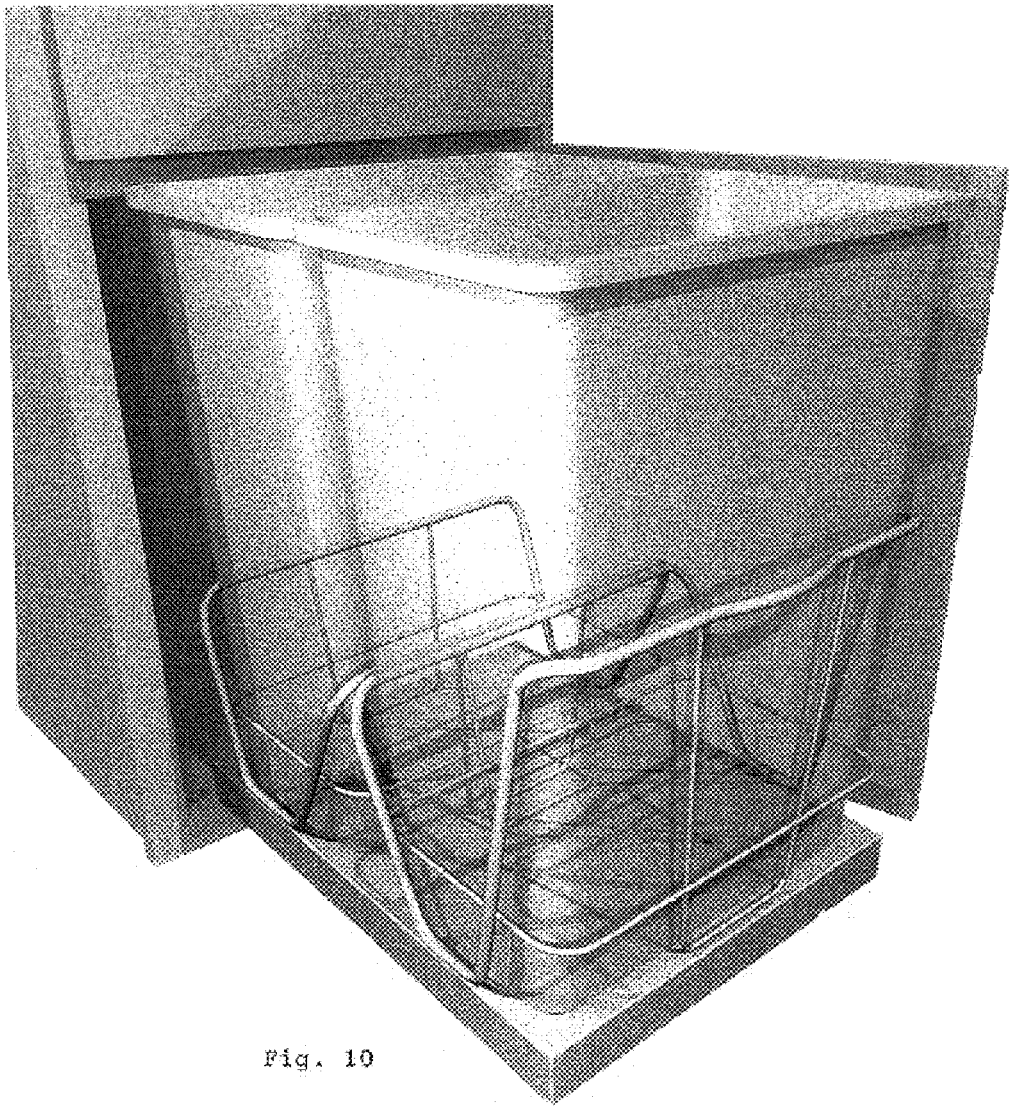
FIG. 10 is a perspective view of another embodiment of a tray, container with top and slide mechanism in an open position.

Slide arrangement 48 is formed of two pairs 56, 58 of cooperating slides viewable at the rear portion of tray 46 but more specifically in FIG. 10 where tray 46 is rotated and viewed from the rear. Slides 56,58 may be similar to those used in drawer construction such as shown in my pending application Ser. No. 10/157,734 where a supporting rail is secured to the cabinet frame, a pull-out rail is secured to the drawer and an intermediate rail is slidably positioned between the two. Alternatively, only a supporting rail attached to the frame and a pull-out rail secured to the drawer need be employed.

Figure 1:
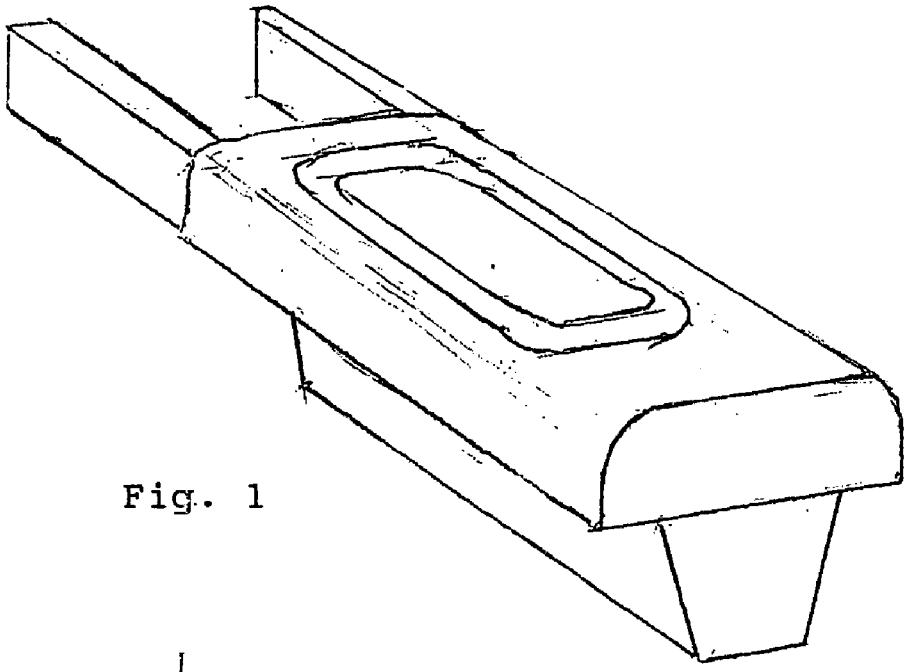
FIG. 1 is a perspective view of a tray carrying a waste container with two pairs of slide mechanisms connecting thereto.
Figure 4:
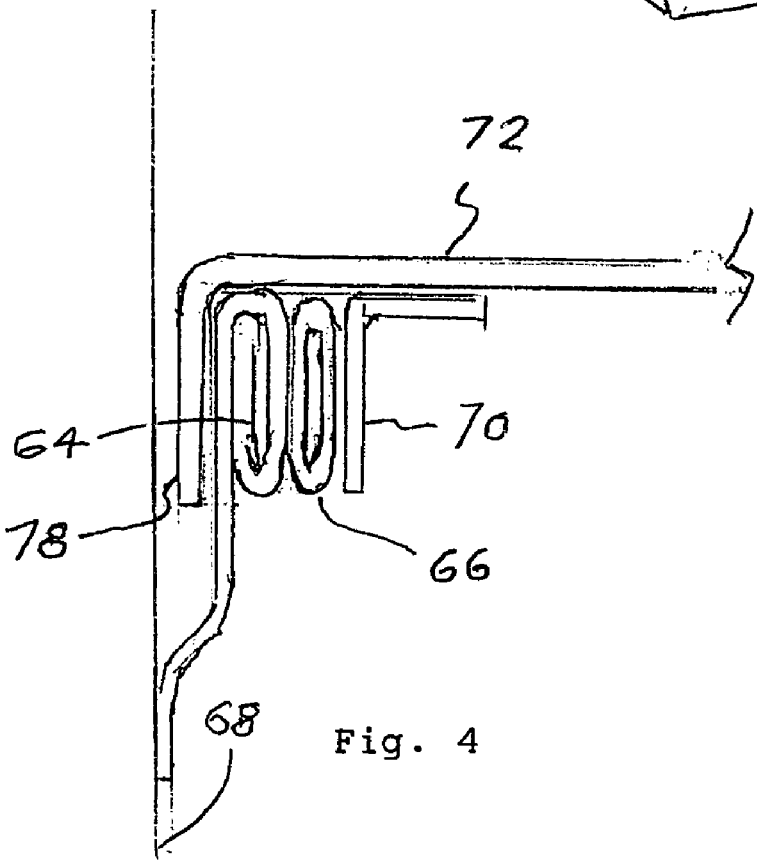
FIG. 4 is an end elevational, enlarged and fragmentary view of two (2) cooperating slide mechanisms affixed to one inside cabinet wall and the underneath side of the tray top.
Figures 1A, 4A, 4B, 4C:
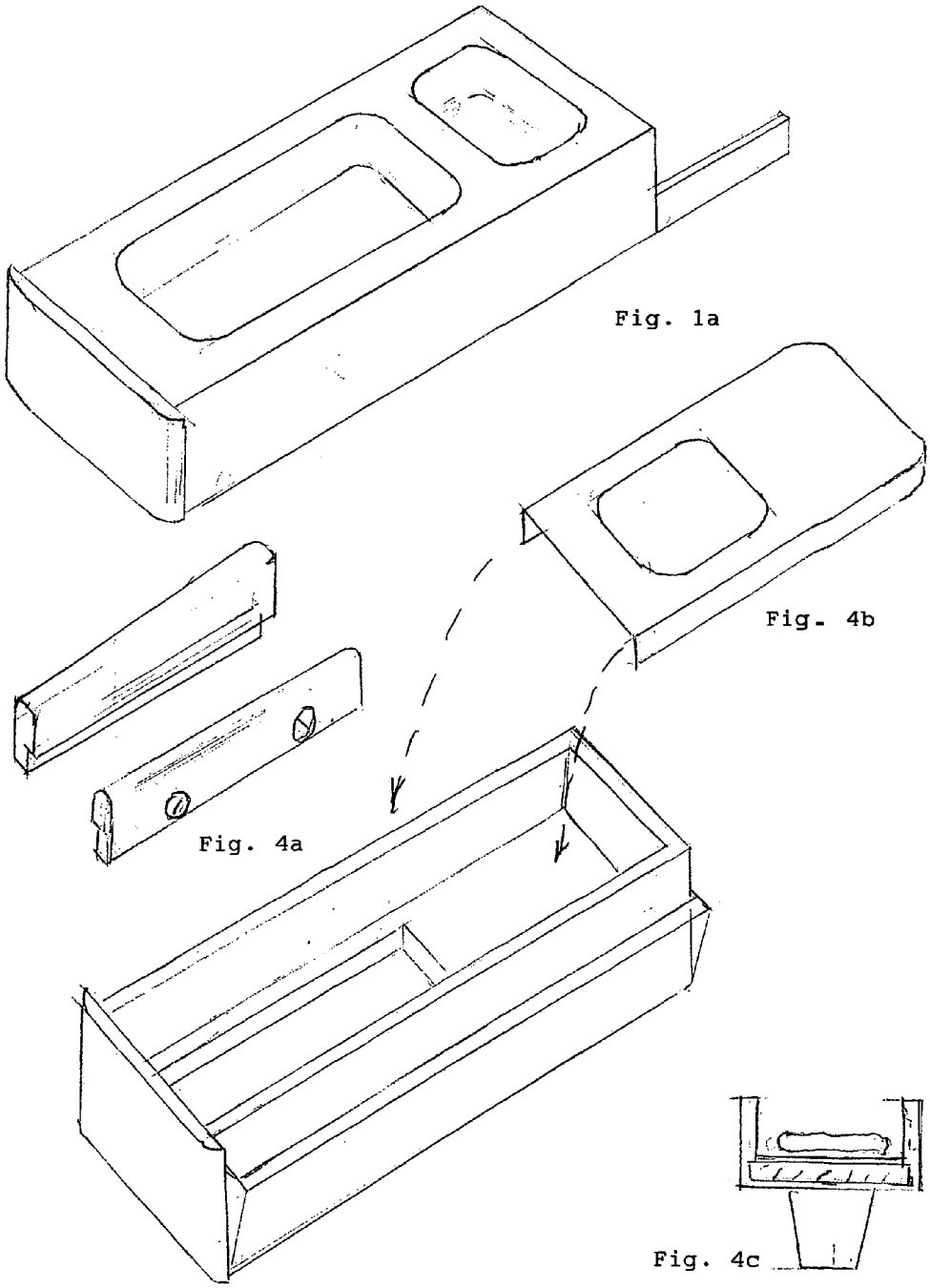
FIG. 1*a* is a fragmentary perspective view of a tray suitable to receive a container within a formed opening wherein the slide mechanisms are contained within the tray side walls.
FIG. 4*a* is a perspective view of a tray top having three walls and a drawer front forming a base within which may be placed a trash container either directly or through an opening in the base bottom or through a lid covering the top of the base.
FIG. 4*b* is a partial perspective view of two (2) side wall slide covers more likely to be used with wire trays.
FIG. 4*c* is an end elevational view of another embodiment of the trash container system wherein separate side walls cover the slide mechanisms and the bottom or floor has an opening which cooperatively receives the waste container.
Figure 2:
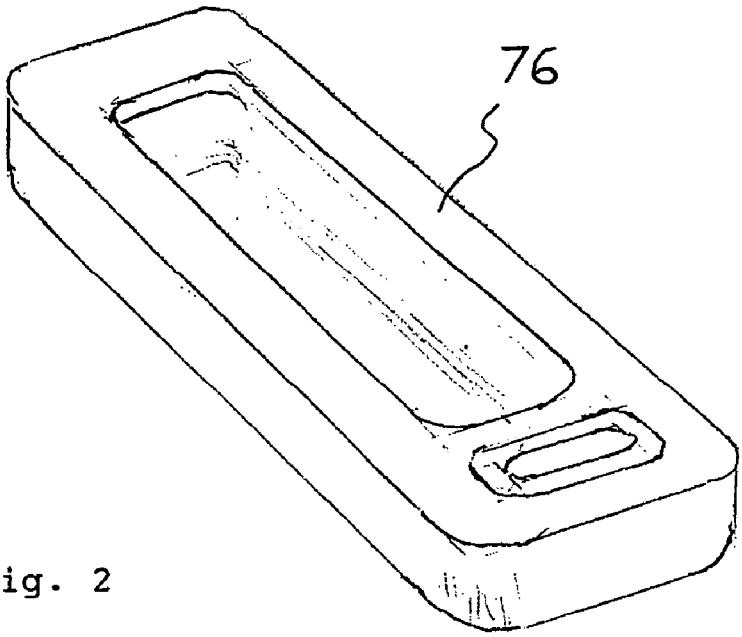
FIG. 2 is a perspective view of one embodiment of a container top designed to hide the slide mechanisms from view and to prevent the collection of dust and refuse thereon.
Figure 3:
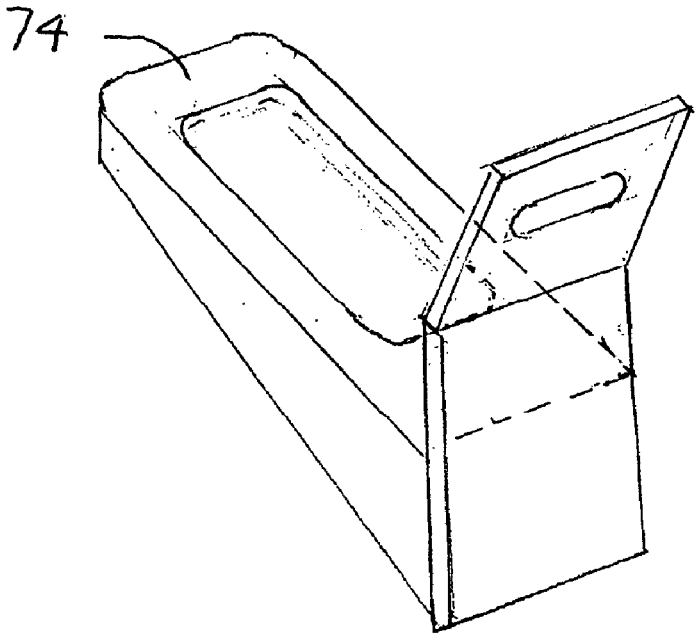
FIG. 3 is a perspective view of another embodiment of a container top with a handle with a handle formed within the frame.

Arrangement 48 of the present invention takes a new form in that the cooperating slides 56, 58 either with two or three rails retract within the walls or base of tray 46 or to the top of container 50 as shown in FIG. 1 so that they are not exposed to dust, grit or trash as is the case when they are mounted on the exterior walls 60, 62 in conventional form. As can be seen in FIG. 4 where two slides 64, 66 are used, first slide 64 is secured to the inside wall or cabinet frame interior 68 of cabinet 40 and second cooperating slide 66 is supported by a bracket 70 on the underneath side of the top 72 which are like or similar to the container tops or caps 74, 76 shown in FIGS. 2 and 3. The depending edge 78 of top 72 completely covers retracted slide 56 to prevent the entry of any foreign matter when tray 46 and carried container are in the closed condition within cabinet 40.

Figure 9:
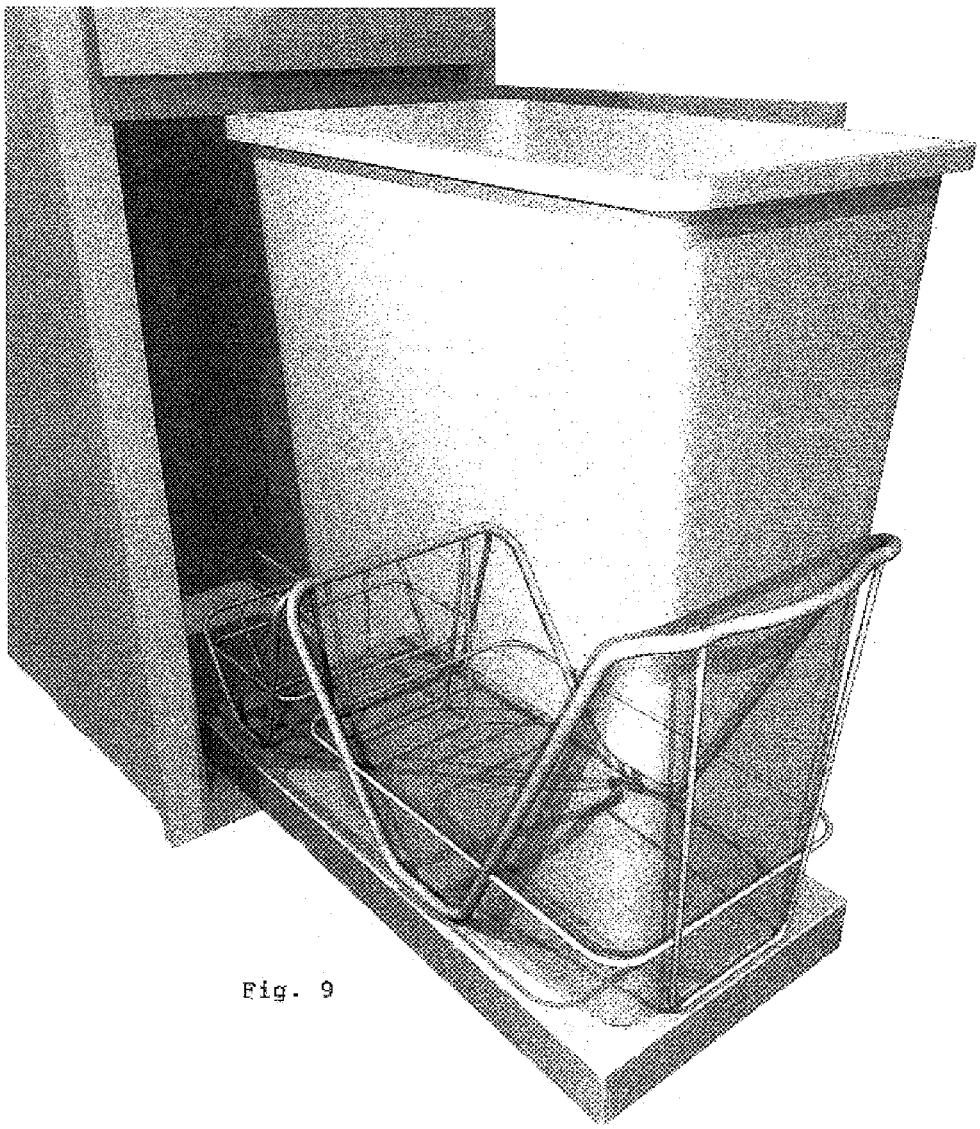
FIG. 9 is a perspective view of another embodiment of a tray, container and slide mechanism in the open position.

Cabinets 40 used to house the waste collection system of the present invention may utilize hinged doors 80 such as shown in FIG. 5 or may accommodate false doors such as that shown as 82 in FIG. 9. Single containers 50 may be used as shown in FIG. 5, however two or even more containers may be preferred as shown as 84, 86 in FIG. 11.

Figure 11:
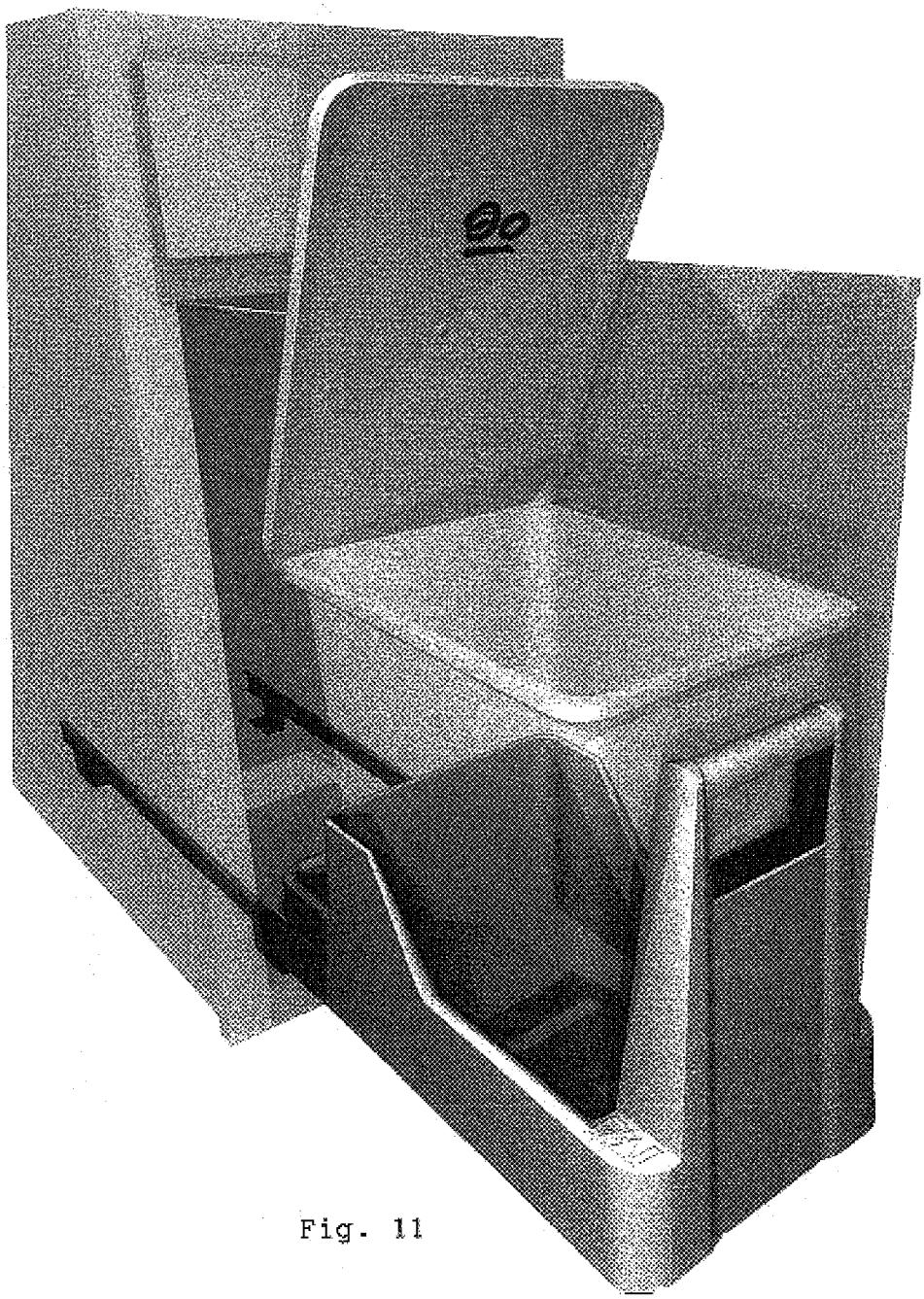
FIG. 11 is a side elevational view of yet another embodiment of a container top designed to hide the slide mechanism from view and to prevent the collection of dust and refuse thereon.

A grid or wire tray such as shown in FIG. 10 may be used instead of the solid or formed frames of FIG. 5 particularly when a less expensive version is desired. Trays 46 may be provided with a lid go such as shown in FIG. 11 if is desired to more closely regulate odor.

From the proceeding description, it can be seen that a waste collection system has been provided that will possess all the advantages of prior art devices and offer additional advantages not heretofore achievable. With respect to the foregoing invention, the optimum dimensional relationship to the parts of the invention including variations in size, materials, shape, form function and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. A kitchen trash container system movable into and out of a cabinet frame interior having upper and lower portions, the system comprising:

a tray slidably movable into and out of the cabinet frame interior, the tray including a substantially downwardly depending edge that defines at least part of a channel positioned along the tray's side;

a slide mechanism operably associated with the tray and cabinet frame interior, wherein the slide mechanism includes a first slide attached to the cabinet frame interior and being upwardly and inwardly off-set from the cabinet frame interior a distance sufficient to allow the downwardly depending edge of the tray to be positioned in-between the first slide and the cabinet frame interior to which the first slide is attached, a second slide attached to the underneath side of the tray; and an interface created by the meeting of the first slide and the second slide, wherein the channel defined at least in part by the downwardly depending edge of the tray receives and covers the interface between the first slide and the second slide on the portion of the slide mechanism substantially adjacent to the side of the tray, thereby preventing dust and waste from spilling onto and fouling the interface during system use; and a waste container carried by the tray and movable therewith to enter the cabinet frame interior and receive discharged waste and move out of the cabinet frame interior to enable the waste to be emptied and the tray-carried container to reenter the cabinet frame interior.

2. The system as claimed in claim 1 wherein the tray has a base portion and the slide mechanism operably connects with the tray within the tray base portion.

3. The system as claimed in claim 2 wherein the slide mechanism connects with the cabinet frame interior lower portion.

4. The system as claimed in claim 2 wherein the slide mechanism connects with the cabinet frame interior upper portion.

5. The system as claimed in claim 4 wherein the slide mechanism includes two pairs of cooperating slides.

6. The system as claimed in claim 1 wherein the slide mechanism connects with the cabinet frame interior lower portion.

7. The system as claimed in claim 1 wherein the slide mechanism connects with the cabinet frame interior upper portion.

8. The system as claimed in claim 1 wherein the slide mechanism includes two pairs of cooperating slides.

9. A kitchen trash container system movable into and out of a cabinet frame interior having upper and lower portions and two side walls, the system comprising:

a substantially horizontal tray having a bottom and side walls, the tray slidably movable into and out of the cabinet frame interior, the tray including a substantially downwardly depending edge that defines at least part of a channel positioned along the tray's side;

a slide mechanism operably associated with the tray side walls and the cabinet frame interior lower portion, wherein the slide mechanism includes a first slide attached to the cabinet frame interior and being upwardly and inwardly off-set from the cabinet frame interior a distance sufficient to allow the downwardly depending edge of the tray to be positioned in-between the first slide and the cabinet frame interior to which the first slide is attached, a second slide attached to the underneath side of the tray; and an interface created by the meeting of the first slide and the second slide, wherein the channel defined at least in part by the downwardly depending edge of the tray receives and covers the interface between the first slide and the second slide on the portion of the slide mechanism substantially adjacent to the side of the tray, thereby preventing dust and waste from spilling onto and fouling the interface during system use; and a waste container carried by the tray and movable therewith to enter the cabinet frame interior and receive discharged waste and move out of the cabinet frame interior to discard the waste and reenter the cabinet frame interior.

10. The system as claimed in claim 9 wherein the slide mechanism includes two pairs of cooperating slides.

11. The system as claimed in claim 10 wherein one pair of cooperating slides are held within one tray side wall and the other pair of cooperating slides are held within another tray side wall.

12. The system as claimed in claim 9 wherein the slide mechanism is operably associated with the tray side walls and the cabinet frame interior upper portion.

13. The system as claimed in claim 9 wherein the slide mechanism includes two pairs of cooperating slides.

14. The system as claimed in claim 13 wherein one pair of cooperating slides are held within one tray side wall and the other pair of cooperating slides are held within another tray side wall.

* * * * *